US005588549A

United States Patent [19]

Furtner

[11] Patent Number: 5,588,549

[45] Date of Patent: Dec. 31, 1996

[54] CONTAINER WITH SWIVELLING SIDEWALLS

[75] Inventor: Josef Furtner, Enns, Austria

[73] Assignee: Steiner Freizeitmöbel Gesellschaft m.b.H. & Co. KG., Pinsdorf/Aurachkirchen, Austria

[21] Appl. No.: 436,358

[22] PCT Filed: Oct. 29, 1993

[86] PCT No.: PCT/AT93/00166

§ 371 Date: Jun. 1, 1995

§ 102(e) Date: Jun. 1, 1995

[87] PCT Pub. No.: WO94/11259

PCT Pub. Date: May 26, 1994

[30] Foreign Application Priority Data

Nov. 18, 1992 [AT] Austria ..... 2284/92

[51] Int. Cl.[6] ..... B65D 6/18

[52] U.S. Cl. ..... 220/7; 220/4.28; 220/6; 220/691

[58] Field of Search ..... 220/6, 7, 4.28, 220/666, 62, 62.1, 676, 677, 682, 691, 692

[56] References Cited

U.S. PATENT DOCUMENTS

| | | | |
|---|---|---|---|
| 1,809,523 | 6/1931 | McLean | 220/7 |
| 3,360,180 | 12/1967 | Venturi | 220/7 |
| 3,446,415 | 5/1969 | Bromley | 220/62 |
| 3,497,127 | 2/1970 | Box | 220/7 |
| 3,628,683 | 12/1971 | Friedrich . | |
| 3,973,692 | 8/1976 | Cloyd . | |
| 4,005,795 | 2/1977 | Mikkelsen et al. | 220/62 |
| 4,044,910 | 8/1977 | Box . | |
| 4,081,099 | 3/1978 | Shead . | |
| 4,202,457 | 5/1980 | Tansi | 220/7 |
| 4,591,065 | 5/1986 | Foy | 220/7 |
| 4,953,735 | 9/1990 | Tisbo et al. | 220/7 |
| 5,501,354 | 3/1996 | Stromberg | 220/7 |

FOREIGN PATENT DOCUMENTS

| | | | |
|---|---|---|---|
| 0067323 | 12/1982 | European Pat. Off. . | |
| 0073357 | 3/1983 | European Pat. Off. . | |
| 0091718 | 10/1983 | European Pat. Off. . | |
| 0211795 | 2/1987 | European Pat. Off. . | |
| 0443327 | 8/1991 | European Pat. Off. . | |
| 2436715 | 9/1978 | France | 220/7 |
| 2160601 | 6/1972 | Germany . | |
| 3444477 | 6/1986 | Germany . | |
| 2163132 | 2/1986 | United Kingdom . | |
| WO92/13771 | 8/1992 | WIPO . | |

*Primary Examiner*—Stephen J. Castellano
*Attorney, Agent, or Firm*—Collard & Roe, P.C.

[57] ABSTRACT

The invention describes a container (1) with a base (2) and side wall parts (3 to 6) connected therewith so as to be orientable from a position approximately vertical to the base (2) into a position flat with the base (2). The side wall parts (3 to 6) are connected with the base (2) via articulation arrangements (8) arranged in the region of the encircling longitudinal and transverse side faces (7). In addition, connecting arrangements (35) are arranged between the side wall parts (3 to 6) corresponding to the longitudinal and transverse side faces (7) and are constructed by a coupling device. This coupling device projects in the direction of an overlapping region (31) of the further side wall part (3 to 6) arranged at 90° and has centering and/or locking elements, in the overlapping region (31) of the further side wall part (3 to 6), centering and/or locking mountings holding these. Between the side wall parts (3 to 6) and/or between these and the base (2) a locking device is arranged, which exerts a prestressing force directed in the engaging direction of the centering and/or locking elements.

24 Claims, 9 Drawing Sheets

Fig. 4
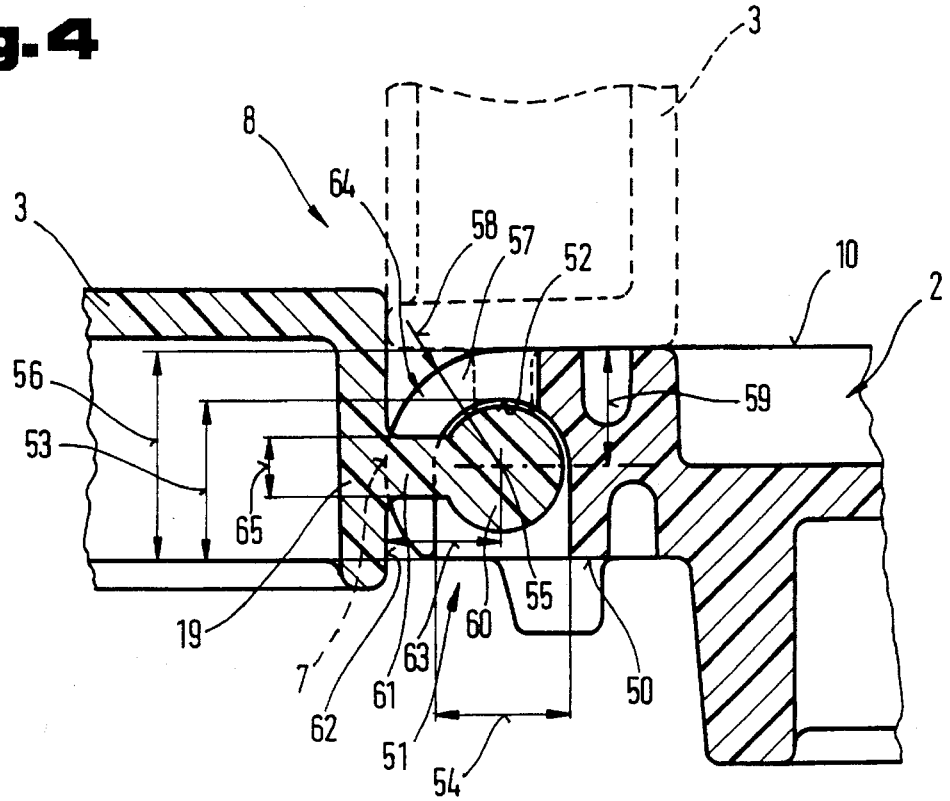
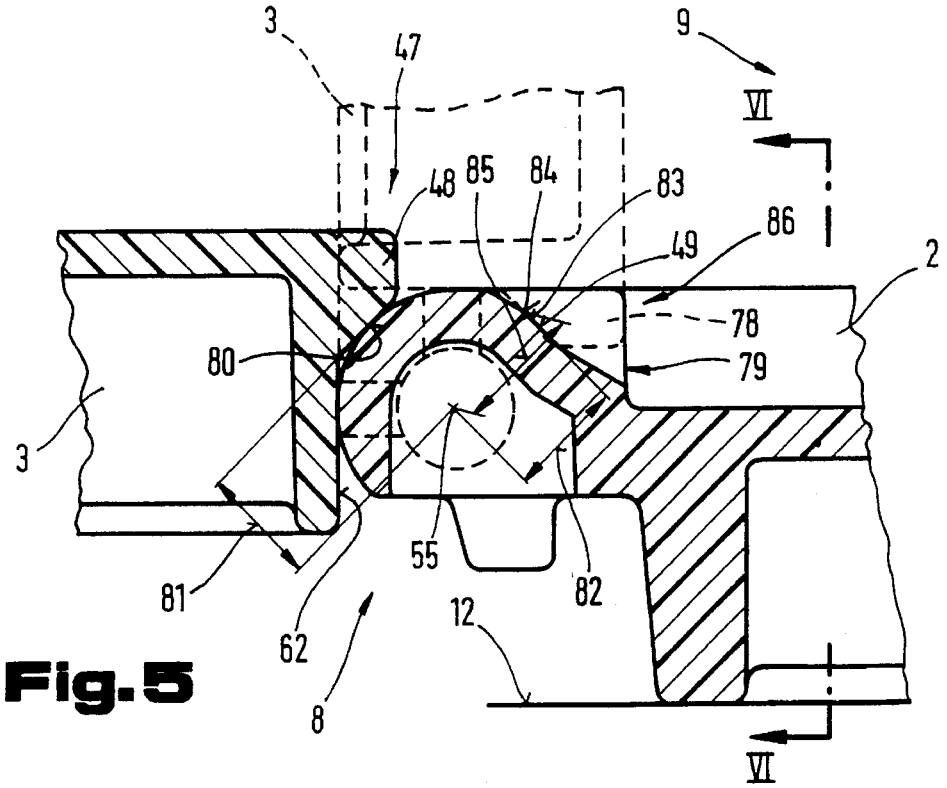
Fig. 5

Fig. 9
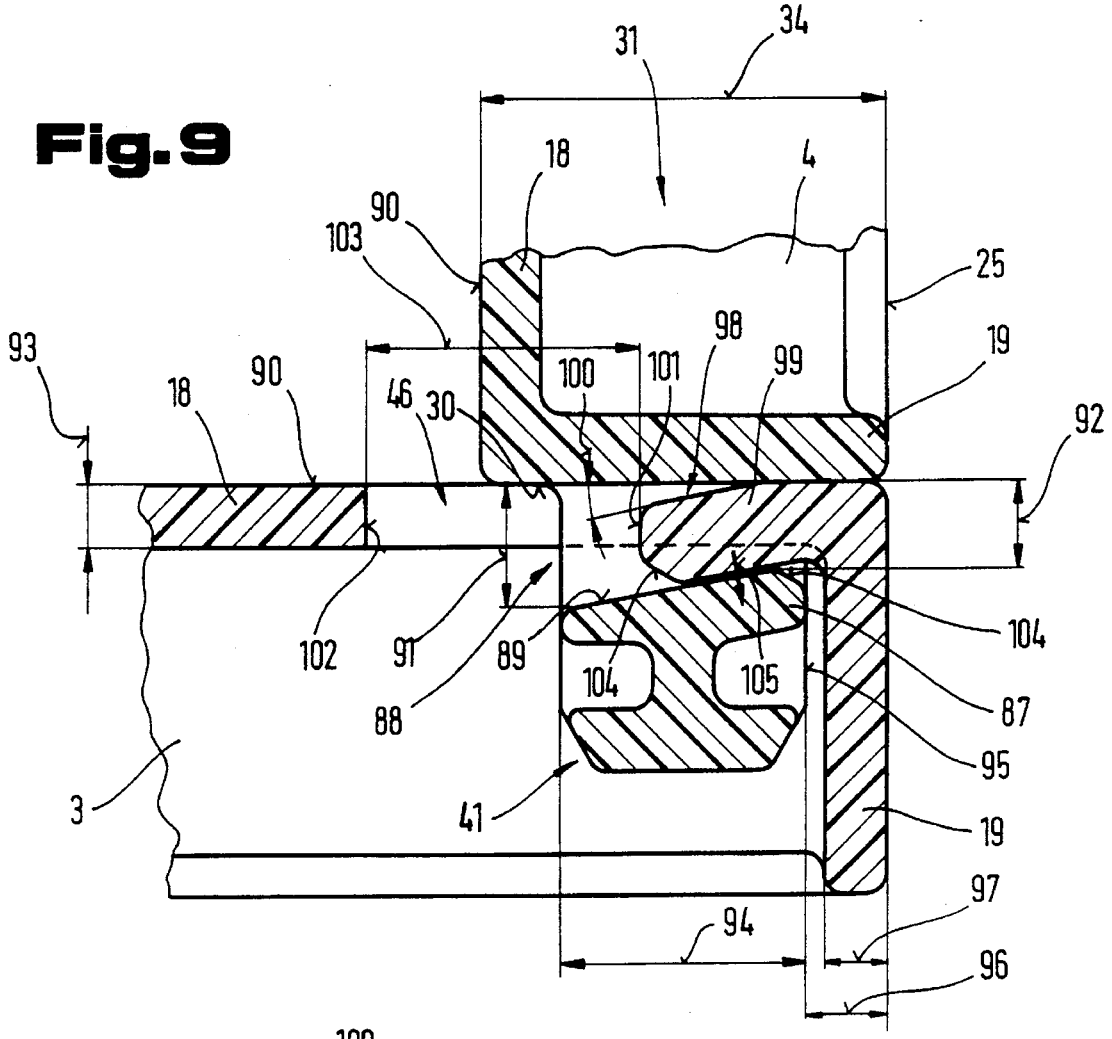
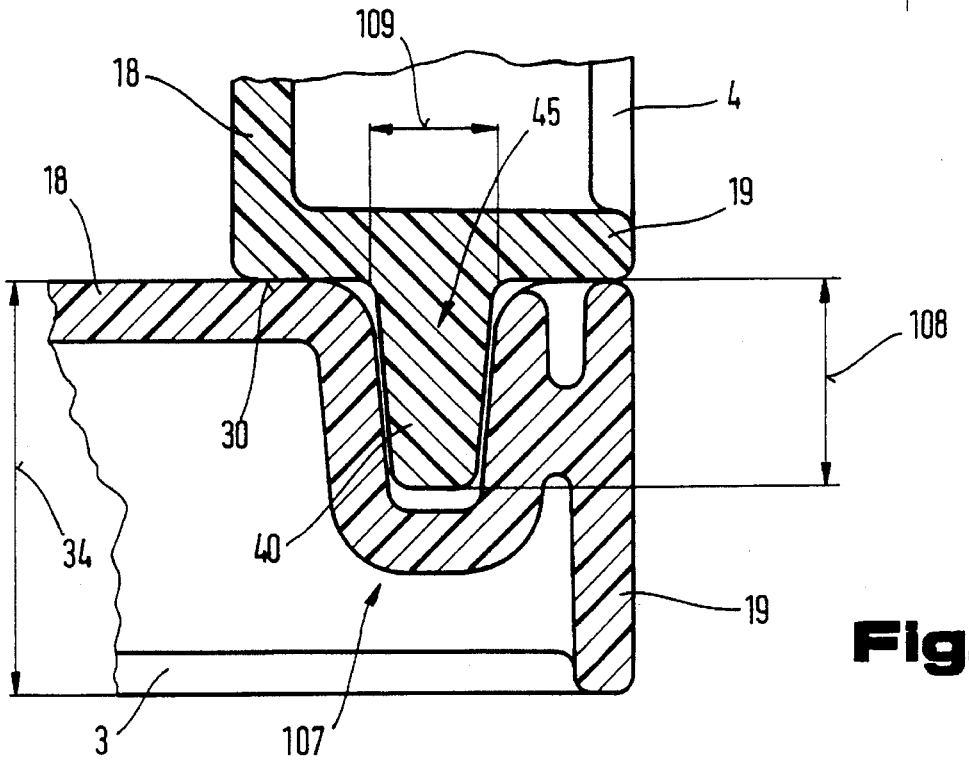
Fig. 10

CONTAINER WITH SWIVELLING SIDEWALLS

The invention relates to a container, as described in the introductory clause of claim 1.

Such containers are preferably constructed so as to be able to be dismantled or able to be folded into themselves, so as to take up a small transportation volume whilst being transported in empty state.

In a known container—according to EP-A-0 211 795—the side walls and end walls have a plurality of cooperating tongues and slits, with which these are attached to each other in circumferential direction of the container and which position the lateral and end walls in position with respect to each other, in which they may be connected with the base. A disadvantage in this construction is that in dismantled state the walls and the base are separate from each other as individual parts and therefore, before being used, the parts have to be sorted and, moreover, the risk exists that individual parts are lost.

In addition a container—according to EP-A-0 443 327—is known, which is able to be folded together into itself and in which four side walls are mounted so as to be orientable on the base and which in the folded in state brings about a multi-layered arrangement of the base and of the side walls. In this embodiment, it is disadvantageous that the articulation arrangements between the side walls and the base, depending on which position the side wall forms in folded in state with respect to the base, have to have a different construction. This requires very expensive and costly tools for the production of these containers and a high risk of fracture of the articulation arrangement under load.

An additionally known construction of a container—according to DE-OS 34 44 477—consists in that on a base part, wall parts are articulated on its encircling marginal sides, which wall parts are able to be folded from a vertical position in righted state to the base part into approximately the plane of the base part. The articulation of the wall parts onto the base part takes place in this embodiment by means of impressions in the material along the fold lines, which form so-called film hinges. In the righted state, the wall parts are positioned by means of connecting arrangements, in particular plug connections, in their position with respect to each other. A disadvantage in this embodiment is that through the impressions, the stability of these containers is impaired and therefore these are better suited for application in apparatus construction for the incorporation of functional elements etc. than for use as transport containers of commodities and goods.

It is now an object of the invention to create a container which takes up a small transportation volume or storage volume in empty state and which, when used as a transport container is distinguished by a large holding capacity both in volume and also in weight of the goods to be carried, and which requires a small number of components.

This object of the invention is achieved through the features quoted in the characterising clause of claim 1. The surprising advantage here is that through the arrangement of the locking elements in the region of the end faces of the wall parts, the latter form with the wall parts approximately one plane and hence no additional space requirement is necessary on transportation or storage of the containers and that through the construction of the locking device with the pre-stressing force acting in the engagement direction, an unintentional loosening of the coupling devices is effectively avoided.

However, an embodiment according to claim 2 is also possible, because thereby even in containers, which have a greater depth through corresponding height of the side wall parts, a secure connection or arresting and positioning of the wall parts with respect to each other is achieved.

An embodiment as described in claim 3 is advantageous here, whereby a high stability of the connecting arrangement is achieved, which makes possible a high lateral load of the wall parts by the material carried by the container.

However, an embodiment according to claim 4 is also advantageous, whereby an integration into the wall structure is made possible and by locking and application of cross-pieces, these connections withstand very high stresses.

Through an embodiment according to claim 5, no additional components are necessary for the connecting arrangement, whereby this is able to be produced at a favourable cost.

A further advantageous embodiment is described by claim 6, because thereby as a result of the restoring effect inherent in the material, tensional forces are achieved which effectively counteract an unlocking.

However, an embodiment according to claim 7 is also advantageous, because thereby tensional forces acting in a punctiform manner are avoided and the surface loading of the tensioning elements is kept low.

A further advantageous embodiment is described by claim 8, whereby in connection with the tensional force an automatic sliding into each other of the tensioning elements up to the end stop is achieved.

According to a possible embodiment according to claim 9, very resistant components are achieved for the coupling extension, which take up a high tensile load.

A preferred further development is described by claim 10, because thereby a division of the tensional forces takes place corresponding to the different external dimensions, in particular the height, distributed on a great length of the side edges.

Through a further embodiment according to claim 11, an introduction of the coupling extensions for locking is facilitated independently of the position of the centering elements.

Through a further development according to claim 12, a uniform bringing into engagement of the centering and coupling elements is achieved, whereby the manipulation on righting and locking the side wall parts is facilitated.

A further advantageous embodiment is described by claim 13, whereby a saving on material is achieved.

Through a construction according to claim 14, an aligning of the side wall parts in the tilted state into the plane of the base is made possible and hence the empty volume is reduced.

A further development according to claim 15 makes possible an exact guidance of the side wall parts during the tilting process.

In a construction according to claims 16 and 17, permanent and wear-free security against an axial displacement and hence an unintentional disengagement of the side wall parts from the base or of the swivel pins from the swivel mountings is achieved. Through the elasticity of the locking element, the joining together of the swivel arrangement is, moreover, facilitated.

However, an embodiment according to claim 18 is also possible, whereby a punctiform arrangement of stop elements is possible and hence a saving on material and weight is achieved.

According to an advantageous embodiment according to claim 19, a locking effect is achieved, with which the side wall parts are held automatically in the righted position, which advantageously brings with it a facilitating of the coupling in of the locking elements.

However, an embodiment according to claim 20 is also possible, whereby the elements of the hold-back arrangement can be produced very simply and at a favourable cost.

However, an embodiment according to claim 21 is also advantageous, because thereby an overload protection for the joint arrangement is achieved on loading of the side wall parts from the direction of the inner space of the container.

Claims 22 to 26 describe an advantageous further development, whereby devices are achieved for the positioning of the containers on being stacked one over the other, which devices position the containers so as to be unable to slip with respect to each other. Furthermore, through the positioning elements which are formed on the base in the state of the containers when stacked onto each other, the side wall parts are fixed on their upper marginal region by the container situated thereabove and the forces acting through the content of the containers onto the side wall parts are taken up by the positioning elements or the base.

Finally, however, an embodiment according to claim 27 is also advantageous, because thereby a problem-free reproducibility of the parts is achieved, and hence an economical manufacture, in particular in large quantities.

For a better understanding of the invention, the latter is explained in further detail with the aid of the example embodiments illustrated in the drawings, in which:

FIG. 4 shows the articulation arrangement in section, according to lines IV—IV in FIG. 2;

FIG. 5 shows a locking device between the base and a side wall part, in section, according to lines V—V in FIG. 2;

FIG. 9 shows the connecting arrangement with the coupling extension, in section according to lines IX—IX in FIG. 7;

FIG. 10 shows the connecting arrangement with the centering element, in section, according to lines X—X in FIG. 7;

Figure 1:
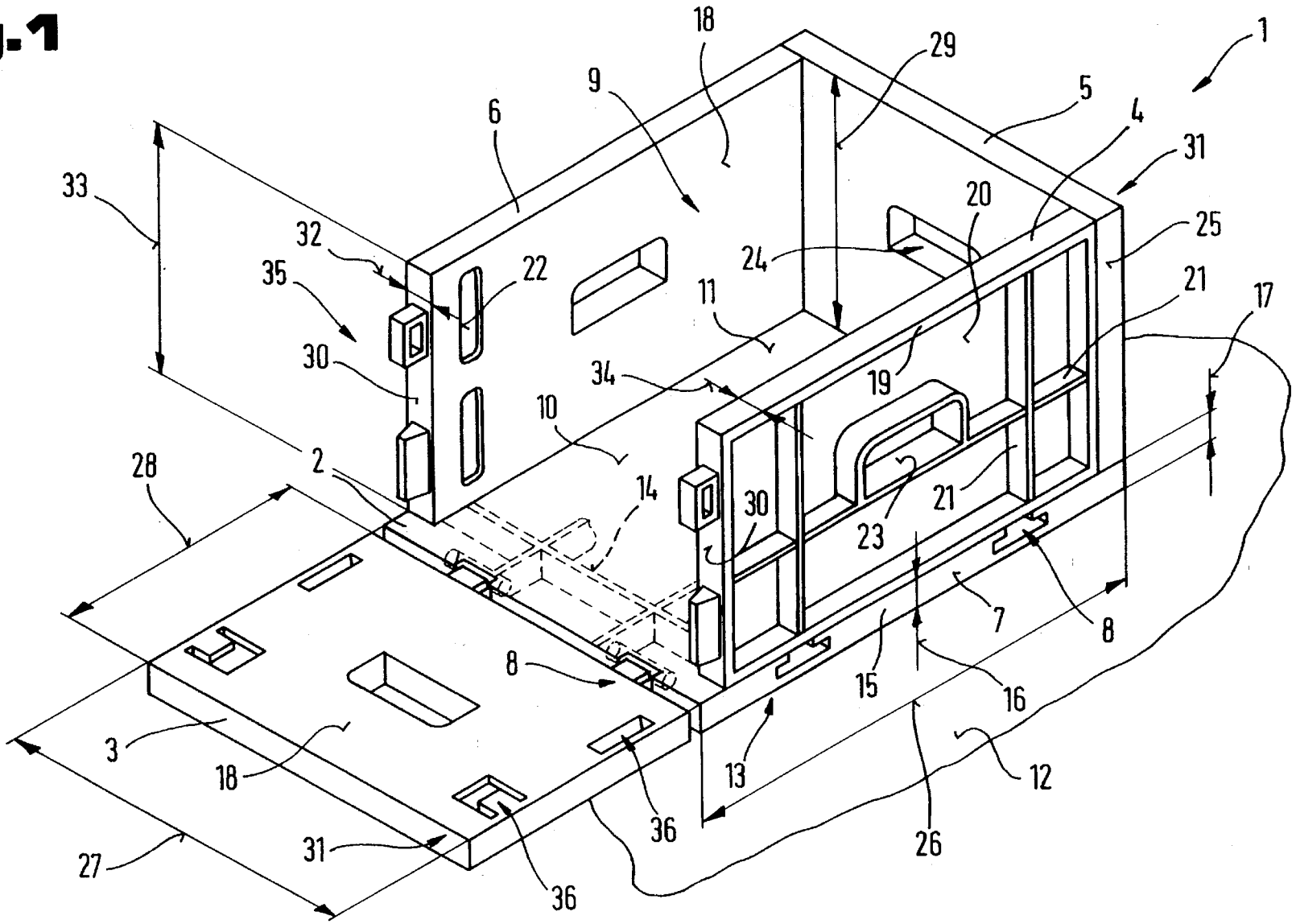
FIG. 1 shows a container according to the invention, in diagrammatic representation.

In FIG. 1 a container 1 is shown. This consists of a base 2 and side wall parts 3,4,5,6, which are orientably connected with the base 2 on its encircling longitudinal and transverse side faces 7 by means of articulation arrangements 8. Via these articulation arrangements 8, the side wall parts 3,4,5,6 are orientable from a position forming approximately a right angle to the base 2 approximately into a position forming a plane with the base 2.

The base 2 has on an upper face 10 facing an interior 9 of the container 1 a base plate 11, which on an underside 13 facing away from the surface 10 and facing a standing face 12 has cross-pieces 14 for reinforcement. These are connected in one piece with the base plate 11 and with marginal strips 15 forming the longitudinal and transverse side faces 7, in particular are formed thereon and onto the base plate 11 . Here, a height 16 of the marginal strips 15 and of the cross-pieces 14 corresponds approximately to a total thickness 17 of the base 2.

Side wall parts 3,4,5,6 are formed, similar to the base 2, by wall plates 18 facing the interior 9, which wall plates 18 have marginal strips 19 arranged in circumferential direction, which project over an outer face 20 of the wall plate 18 facing away from the interior 9 and on which, additionally, cross-pieces 21 are arranged, which are connected in one piece with the marginal strips 19 and the wall plate 18. The side wall parts 3,4,5,6, moreover, preferably have openings 22 in the wall plates 18, which serve for the ventilation of goods carried in the container 1. Furthermore, handle openings 24 are provided in the side wall parts 3,4,5,6, which openings are edged by cross-piece-like reinforcement elements 23.

If the side wall parts 3,4,5,6 are in their righted position, in which they form an angle of 90° with the base 2, then an outer casing surface 25, formed by the marginal strips 19 and, if necessary, the cross-pieces 21, runs within or congruent with a length 26 and a width 27 of the base 2. Thereby, in the region of a height 28 of the side wall parts, which corresponds to a depth 29 of the container 1, an overlapping region 31 is formed by end faces 30 formed by the marginal strips 19 and wall plates 18 facing thereto. Its width 32 corresponds to a height 33 of the marginal strips 19 or a total thickness 34 of the side wall parts 4,6 running at right angles thereto.

On the end faces 30, connecting arrangements 35 are arranged, which project over the end faces 30 in the direction of the side wall parts 3,5 adjoining in the overlapping region 31 and with which mountings 36 are associated therein.

Figure 2:
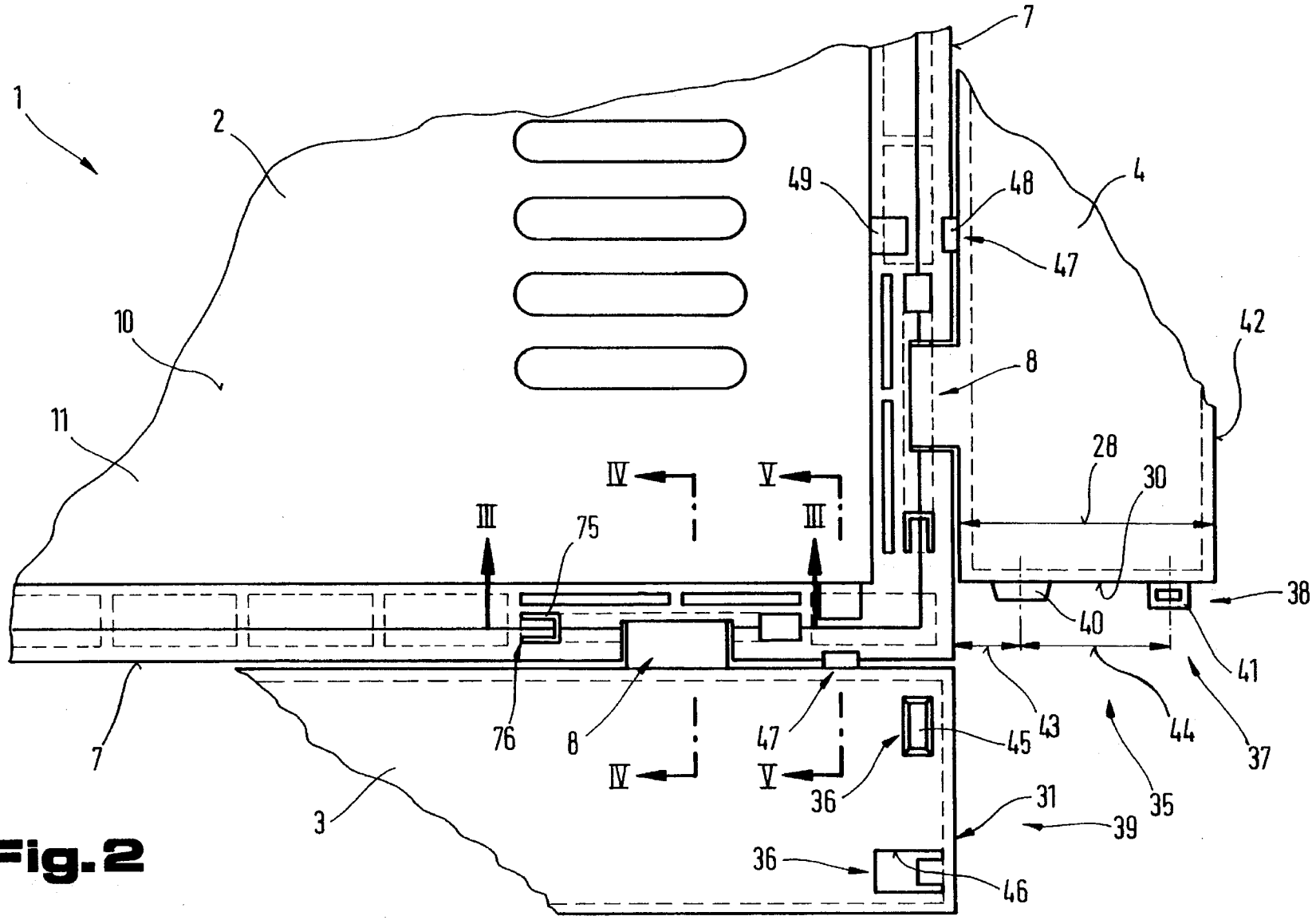
FIG. 2 shows a partial region of the base of the container according to the invention with side wall parts tilted into a plane with the base.

In FIG. 2 a partial region of the container 1 is illustrated with the base 2, and the side wall parts 3,4 arranged in the region of its encircling longitudinal and transverse side faces 7 via the articulation arrangements 8. These side wall parts are shown tilted in their position forming a plane with the base 2. In the position of use the side wall parts 3,4,5,6 form with the base 2 an angle of 90°. The side wall part 4 is equipped on the end side face 30 with the connecting arrangement 35, with which are associated the mountings 36 of the side wall part 3 in the overlapping region 31. The connecting arrangement 35 is formed by a coupling device 38 having centering and/or locking elements 37, which cooperate with the mountings 36, formed by centering and/or locking mountings 39. The centering and/or locking elements 37 comprise, in the direction of the height 28 of the side wall parts 4 or 6, in each case, at a distance, a strip-shaped centering extension 40 and a coupling extension 41, which project over the end side face 30 of the side wall part 4 or 6 in the direction of the adjoining side wall part 3 or 5. Preferably the centering extension 40 is arranged adjacent to the base 2, whereas the coupling extension 41 is, rather, associated with the region of an upper edge 42 of the container 1 or of the side wall part 4. Corresponding to a mean distance 43 of the centering extension 40 from the longitudinal and transverse side face 7 and a mean distance 44 between the centering extension 40 and the coupling extension 41, a centering mounting 45 and a coupling opening 46 of the centering- and/or locking mounting 39 are arranged in the overlapping region 31 of the associated side wall part 3.

In the region of the longitudinal and transverse side faces 7 and adjacent to the articulation arrangements 8, elements of a locking device 47 for the side wall parts 3,4,5,6 are arranged, which are constructed in the form of stops 48, which cooperate with support faces 49 in the surface 10 of the base plate 11. Through this locking device 47, an effective delimitation of the swivel angle of the side wall parts 3,4,5,6 is ensured in the direction of the base 2. Furthermore, through the construction of the stops 48 and the support faces 49, a free tilting of the righted side wall parts 3,4,5,6 into the plane with the base is prevented or is only possible after overcoming a resistance provided by a crank-shaped construction of the support face 49.

Figure 3:
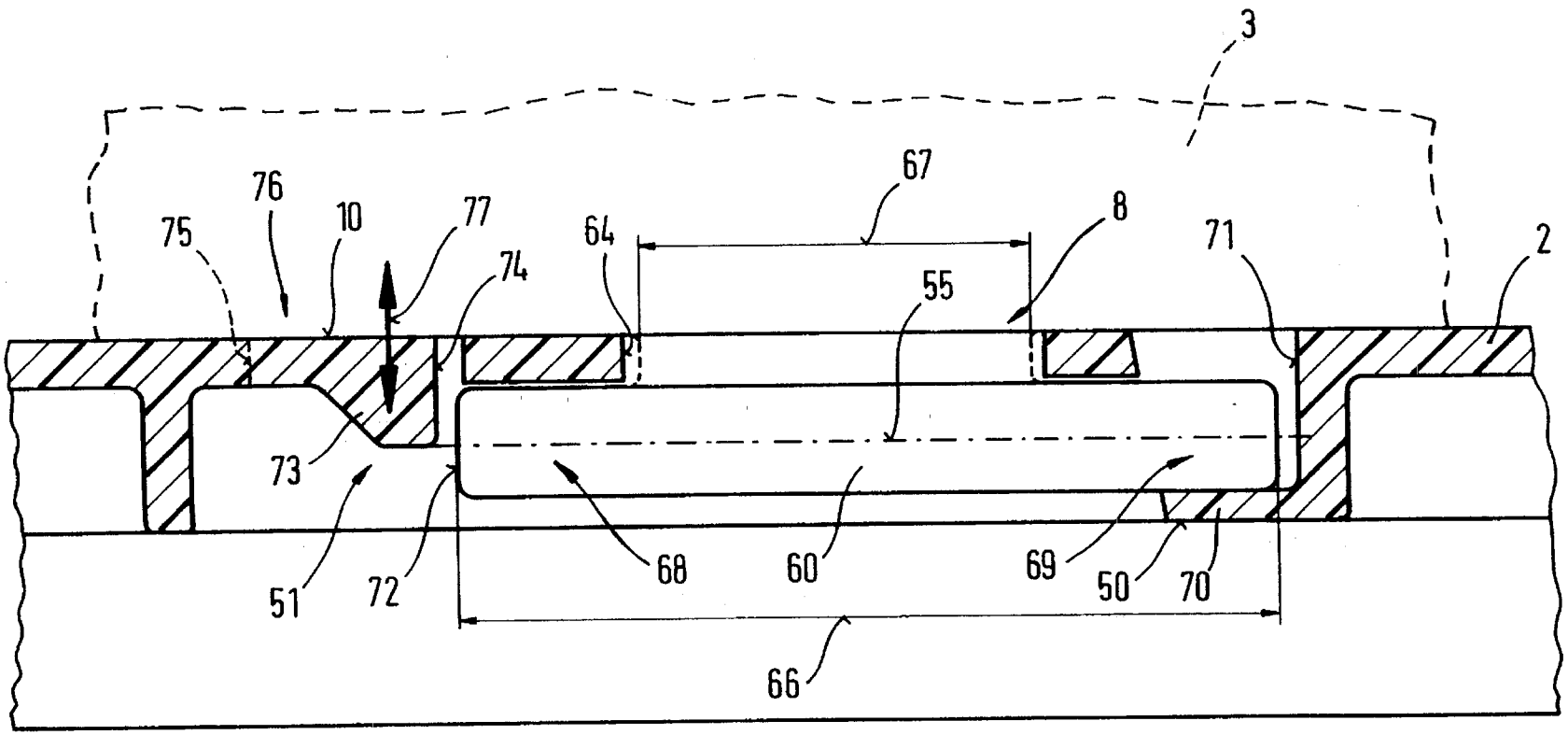
FIG. 3 shows an articulation arrangement between the base and a side wall part of the container according to the invention, in section, according to lines III—III in FIG. 2.

In FIG. 3 and 4 the articulation arrangement 8 is shown between the side wall parts 3,4,5,6, for example for the side wall part 3 and the base 2. In these illustrations, the side wall part 3 is shown in its position forming a plane with the base 2 in solid lines, and in its position assuming an angle of

90° with the base in dot-and-dash lines. The base 2 has a groove 51 running parallel to the encircling longitudinal and transverse side face 7 on an underside 50 facing away from the surface 10. A groove base 52 facing the surface 10 is constructed in a semicircular shape, in which a depth 53 of the groove 51 is greater than a width 54. A longitudinal central axis 55 of the articulation arrangement 8 running parallel to the longitudinal and transverse side faces 7 and the surface 10 is approximately in the centre of a thickness 56 of the base 2 or of a marginal strip 57 forming the longitudinal and transverse side face 7. The longitudinal and transverse side face 7 is rounded in a circular shape in a direction running transversely to its longitudinal extent, in which a radius 58 proceeding from the longitudinal central axis 55 corresponds to a distance 59 between the surface 10 of the base 2 and the longitudinal central axis 55. Concentrically to the longitudinal central axis 55 in the groove 51 a swivel pin 60 is arranged, extending in the direction of the longitudinal central axis 55, which is movably connected via a connecting cross-piece 61 with the side wall part 3 or a side face 62 facing the base 2, which projects over the side wall part 3 in the direction of the marginal strip 19 delimiting the base 2. A distance 63 between the side face 62 and the longitudinal central axis 55 corresponds here approximately to the radius 58 of the circularly rounded longitudinal and transverse side face 7.

In the region of the connecting cross-piece 61, the marginal strip 57, holding the groove 51 is provided with a recess 64 to hold the connecting cross-piece 61, extending from the longitudinal and transverse side face 7 by the distance 63 including half the dimension of a thickness 65 of the connecting cross-piece 61 in the direction of the region of the base 2 associated with the interior space 9. In the direction of its longitudinal extent the swivel pin 60 has a length 66, which corresponds approximately to twice a width 67 of the connecting cross-piece 61 . Thereby, end regions 68,69 of the swivel pin 60 are formed projecting over the connecting cross-piece 61, via which end regions the side wall part 3 is orientably secured in the groove 51 . Here the groove 51 is closed in one of the end regions 68,69, as illustrated, in the end region 69 in the direction of the underside 50 over the width 54 running through a holding extension 70, whereby a receiving chamber 71 for the end region 69 of the swivel pin 60 is formed.

There is associated with an end face 72 of the swivel pin 60, arranged in opposition to the receiving chamber 71 a locking element 73 delimiting the groove 51 in its longitudinal extent, which locking element is formed on the base 2 and extends from the surface 10 into the region of the longitudinal central axis 55 and, facing the end face 72, forms a stop face 74, which counteracts an axial displacement of the swivel pin 60. Opposite the base 2, the locking element 73 is elastically deformable via a weakening region 76, formed by slits 75, in vertical direction corresponding to a double arrow 77. Thereby a joining into each other of the articulation arrangement 8 through introduction of the swivel pin 60 into the groove 51 and the receiving chamber 71 is facilitated. Through swinging the locking element 73 out from its locking position for the swivel pin 60, a separation of the articulation arrangement 8 is made possible and hence the side wall parts 3,4,5,6 are separated from the base 2.

Figure 6:
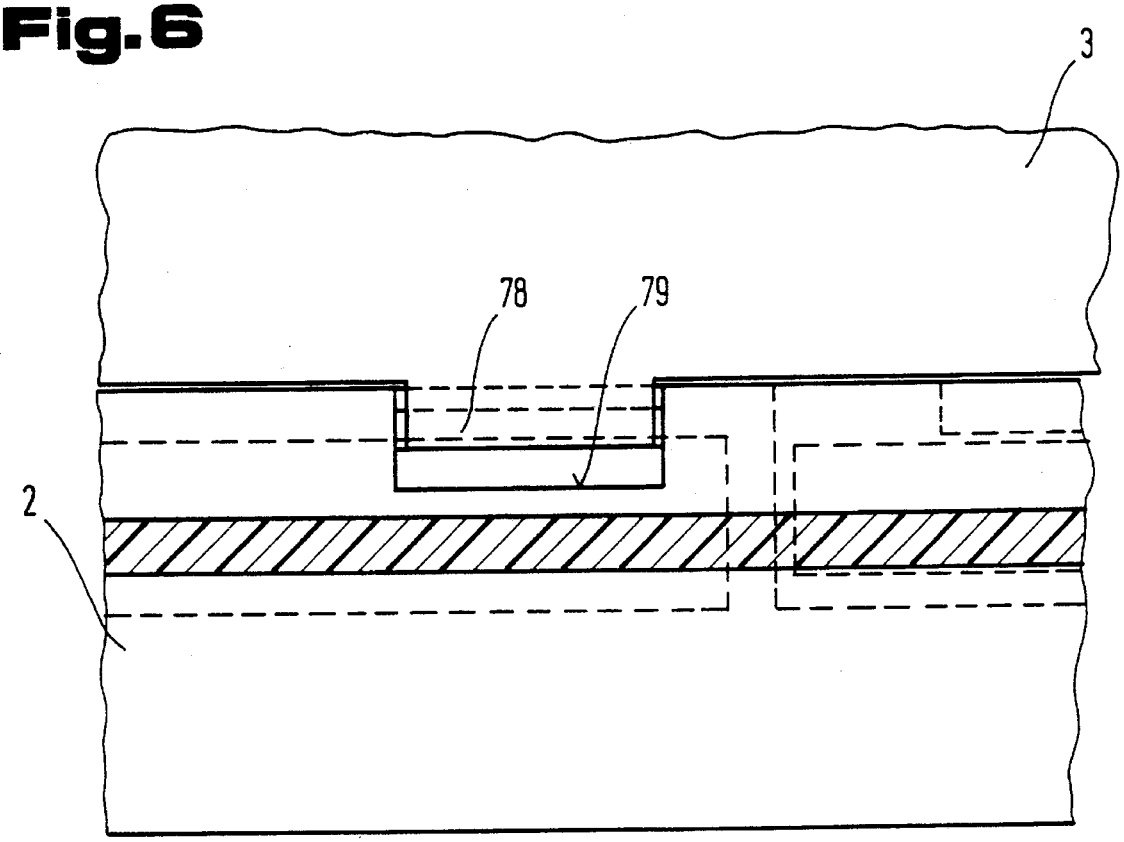
FIG. 6 shows the locking device in side view in section, according to lines VI—VI in FIG. 5.

As can now be seen better from FIG. 5 and 6, the articulation arrangement 8 is arranged adjacent to the locking device 47 for the side wall part 3 with the base 2.

In FIG. 5 the swung up position of the side wall part 3, analogous to FIG. 4, is illustrated in dot-and-dash lines and the flat position is illustrated in solid lines, whereas in FIG. 6 the swung up position is illustrated in solid lines. The locking device 47 is formed by an extension 78, forming the stop 48, projecting over the side face 62 of the marginal strip 19, with which extension the support face 49 is associated which is formed by a recess 79 in the base 2. A contact face 80 of the stop 48 and the support face 49, cooperating therewith, of the recess 79 run here approximately in a plane which forms with the side face 62 or with the standing face 12, an angle of approximately

45° and from the longitudinal central axis 55 in the direction of the interior 9 has a distance 81 measured vertically onto the plane, which distance corresponds approximately to the radius 58 of the longitudinal and transverse side face 7 which is rounded in a circular shape transversely to the longitudinal extent. Through the selection of a distance 82, measured parallel to the distance 81, between the longitudinal central axis 55 and the contact face 80, there occurs in the righted position of the side wall part 3 a prestressing force between the support face 49 and the contact face 80 in the direction of tilting of the side wall part 3 into the position forming a plane with the base 2.

At the same time, the support face 49 forms a sliding path 83 with a control edge 84 for the contact face 80 of the stop 48, in which a distance 85 of the control edge 84 from the longitudinal central axis 55 is greater than the radius 58, whereby a resistance is opposed to the tilting of the side wall part 3 into the position which is plane with the base.

Through this construction of the locking device 47 with the support face 49 and the control edge 84 and also the contact face 80 of the stop 48, a prestressing- or holding-back device 86 is achieved between the base 2 and the side wall parts 3,4,5,6.

This makes possible a tilting of the side wall parts 3,4,5,6 into their righted position and a gradual bringing into engagement of the centering and/or locking elements 37 with the centering and/or locking mountings 39, without, on carrying out the process, the side wall parts 3,4,5,6 unintentionally tilting into the plane of the base 2. Furthermore, through the prestressing or holding-back device 86 in the coupled state of the centering and/or locking elements 37, a prestressing force is exerted, directed in the engagement direction thereof, whereby an unintentional uncoupling is effectively prevented.

In FIG. 7 to 10, the connecting device 35 between the side wall parts 3,4,5,6 is shown, with the example of the side wall parts 3,4. The connecting device 35 is formed by the coupling extension 41 and the centering extension 40, which project over the end side face 30 of the side wall part 4 in the overlapping region 31 in the direction of the further side wall part 3, and with which there is associated in the side wall part 3 the centering mounting 45 or the coupling opening 46.

The coupling extension 41 is constructed in the form of a strip element 87 extending in longitudinal direction of the end side face 30, which strip element has at least one slit-shaped recess 88 arranged along the end side face 30. A contact face 89, opposite the end side face 30 and forming a boundary of the recess 88, runs at an angle of approximately 10° to the end side face 30, in which a slit width 91, facing the inner surface 90, is greater than a slit width 92 facing the outer covering surface 25. This corresponds approximately to a thickness 93 of the wall plate 18. A width 94 of the strip element 87 is approximately ½ to ⅔ the total thickness 34 of the side wall part 4. A side face 95 of the strip element 87, facing the covering surface 25, is arranged at a distance 96 from the plane formed by the covering surface 25, which distance is slightly greater than a thickness 97 of the marginal strip 19 of the side wall part 3.

The wall plate 18 of the side wall part 3 has in the overlapping region 31 with the side wall part 4 the coupling opening 46, into which a detent arm 98 projects, which is connected in one piece with the marginal strip 19, and which in the engagement position engages into the recess 88 widening conically in the engagement direction. The detent arm 98, which is formed by a wall section 99 of the wall plate 18 and has approximately its thickness 93, is deformed with respect to the inner surface 90 by an angle 100 in the direction of the conical widening of the recess 88 and overlaps the contact face 89 approximately by half the width 94 of the strip element 87. An end face 101 of the detent arm 98, facing away from the marginal strip 19, has a distance 103 from a bearing face 102 delimiting the coupling opening 46 on the side facing away from the marginal strip 19, which corresponds approximately to the width 94 of the strip element 87.

The detent arm 98 running by the angle 100 to the inner surface 90 is connected with the marginal strip 19 so as to be elastically deformable in the direction of the inner surface 90. Hence it is now possible, after the introduction of the coupling extension 41 into the coupling opening 46 of the side wall part 3 to introduce the elastically deformable detent arm 98 into the recess 88 from the direction of the smaller slit width 92 of the recess 88, in which chamfers 104 form slide faces, through which the process is facilitated. Through the spring-back of the detent arm 98 into its original position corresponding to the conical widening of the recess 88, a secure and automatically non-detachable detent is achieved. At the same time, the elastic force brought about on the contact face 89 by the detent arm 98 in the direction of an arrow 105 brings about a pressing against each other of the side wall parts 3,4 in the overlapping region 31.

Of course it is also possible, in the direction of the longitudinal extent of the end side face 30, to provide a plurality of recesses 88 for a corresponding number of detent arms 98 or to select a width 106 of the detent arms 98 so as to be correspondingly big so that the engagement effect acts over a relatively large partial region of the height 28 of the marginal strip 19 or of the overlapping region 31.

Preferably the coupling extension 41 is arranged with the coupling opening 46 in the close proximity of the upper edge 42 of the container 1 . However, it is also possible, in particular with containers 1 which have a great depth 29, to provide a plurality of centering and/or locking elements 37 distributed over the height 28, and also centering and/or locking mountings 39.

At a distance from the coupling extension 41 in the direction of the base 2, the centering extension 40 is arranged, projecting over the end side face 30 of the side wall part 4, which centering extension is formed by a strip-shaped element with a preferably trapezoidal cross-section. There is associated with the centering extension 40 in the overlapping region 31 in the wall plate 18 a mounting pocket 107 corresponding to the cross-section of the centering extension 40. A height 108 of the centering extension 40 corresponds approximately to half the total thickness 34 of the side wall part 3. A base thickness 109 of the centering extension is approximately ¼ of the total thickness 34. A length 110 of the strip-shaped centering extension 40 is approximately half the height 28 of the end side face 30. Of course, it is also possible to arrange several such centering extensions 40 distributed over the height 28. Furthermore, it is also possible to arrange over the height 28 several frustum-shaped centering elements 111 instead of the centering extension 40 or additionally thereto, which engage into corresponding bores 112 of the wall plate 18.

Through the preferably trapezoidal construction of the centering extensions 40 an engagement, free of play, of the centering extensions 40 into the mounting pockets 107 is achieved. Thereby, loads such as occur on carrying the containers on two opposite side wall parts and therefore generally on side wall parts of shorter construction, are also effectively transferred to the adjoining side wall parts. Therefore, these containers are suitable for higher weight capacities.

Through the centering and/or locking elements 37 and the connecting arrangement 35 formed by the centering and/or locking mountings 39, an effective connection is achieved between the side wall parts 3,4,5,6 and a buckling of the side wall parts when a loading of the side wall parts 3,4,5,6 occurs by goods stored in the container is effectively prevented.

Figure 11:
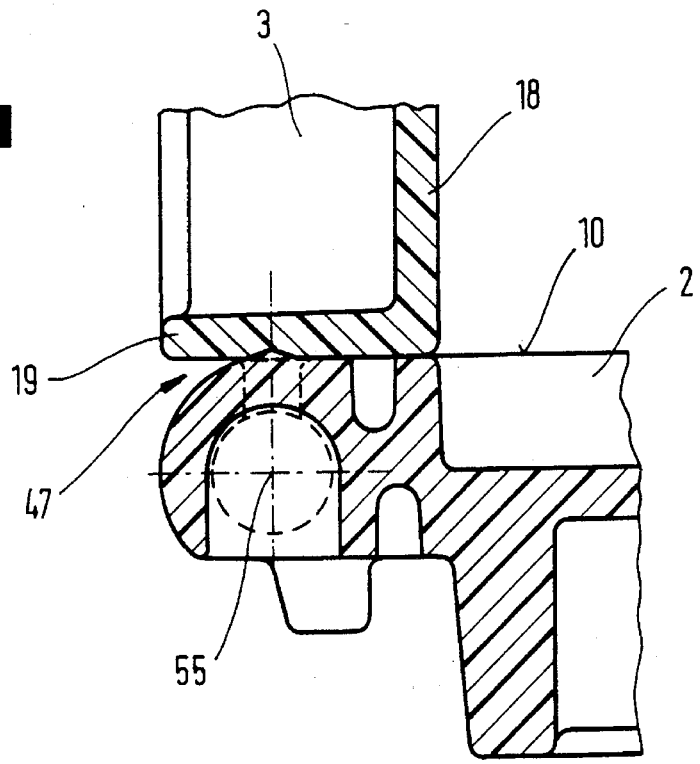
FIG. 11 shows a further embodiment of the locking device of the container according to the invention, in front view in section.
Figure 7:
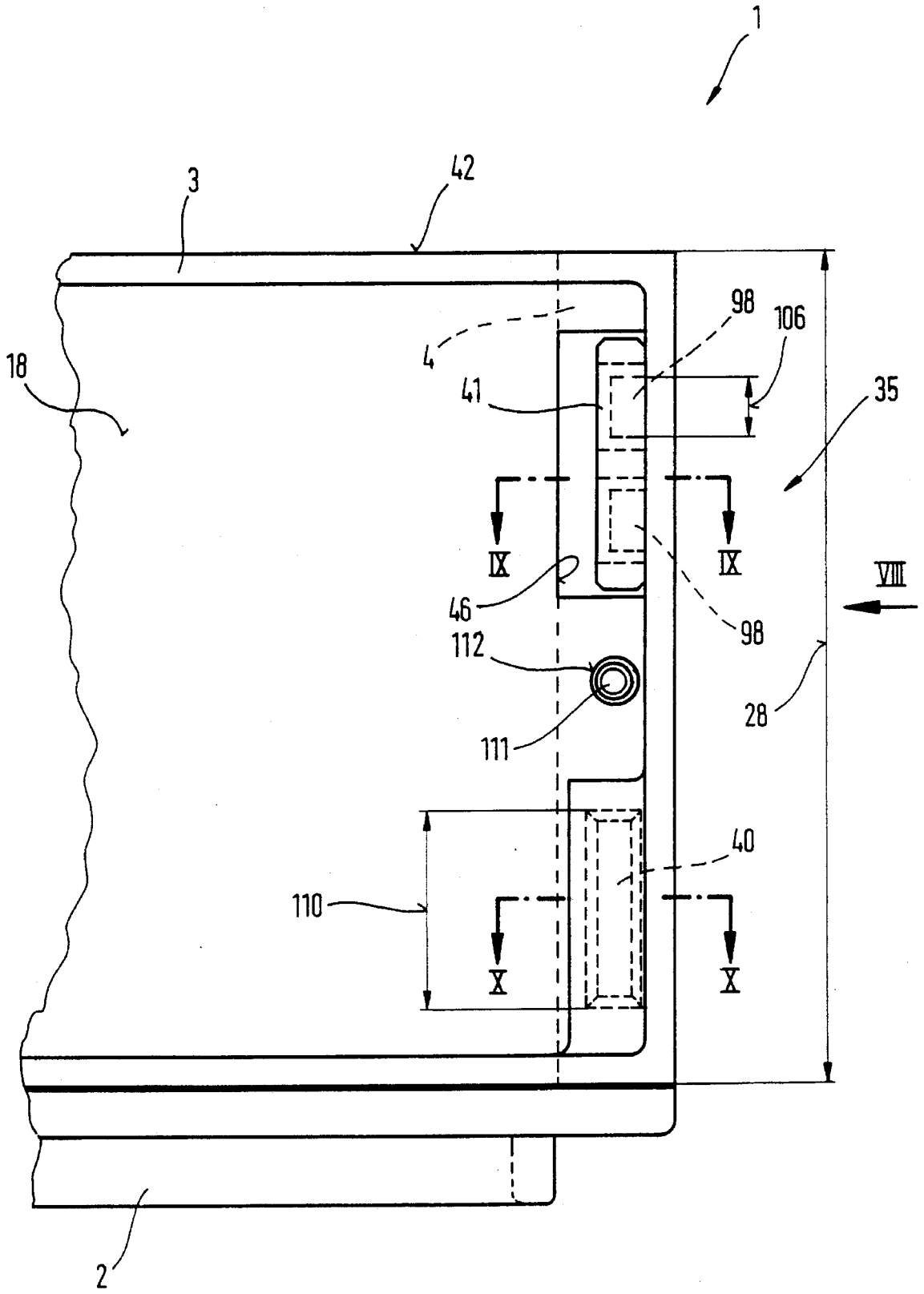
FIG. 7 shows a connecting arrangement between the side wall parts of the container according to the invention in the righted and locked position.
Figure 8:
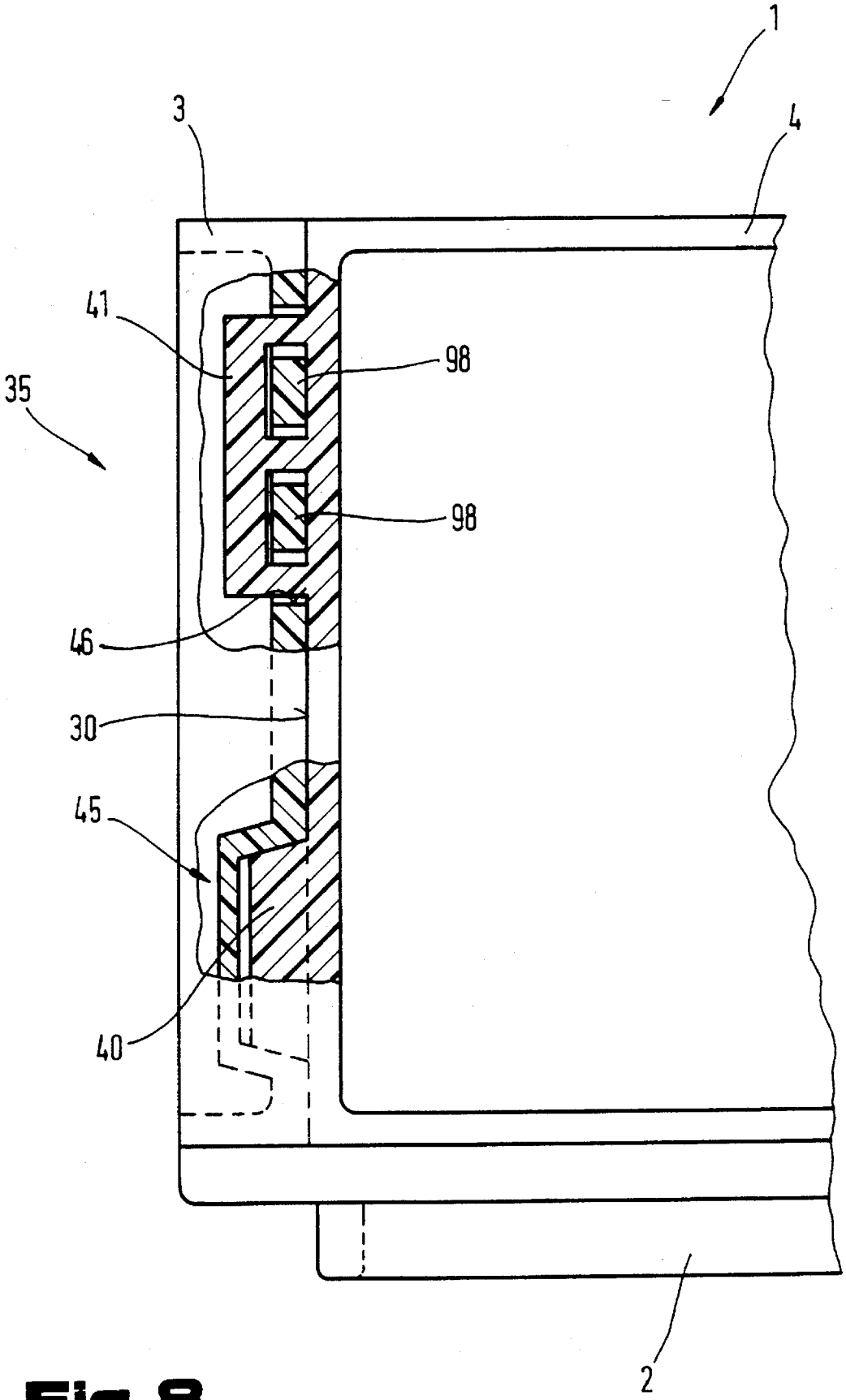
FIG. 8 shows the connecting arrangement between the side wall parts in a side view, according to arrow VIII in FIG. 7, partially in section.

In FIG. 11, a further construction of the locking device 47 is shown between the base 2 and the side wall parts 3,4,5,6. In this, the base 2 has a bead-shaped elevation running parallel to the longitudinal and transverse side faces 7 and projecting over the surface 10 in the direction of the side wall parts 3,4,5,6. Transversely to its longitudinal extent, this elevation is constructed approximately in the form of a half saddle roof, in which a ridge spine runs congruently to the longitudinal central axis 55 of the articulation arrangement 8. In the marginal strip 19 adjoining the side wall parts 3,4,5,6 in the direction of the base 2, a recess is arranged matched to the cross-sectional form of the bead-shaped elevation. Thereby, a cooperating slide construction is produced, which engages in the righted position of the side wall parts 3,4,5,6, and resists a tilting of the side wall parts 3,4,5,6 into the flat position with the base 2 and hence keeps the side wall parts 3,4,5,6 in the righted position.

Figure 12:
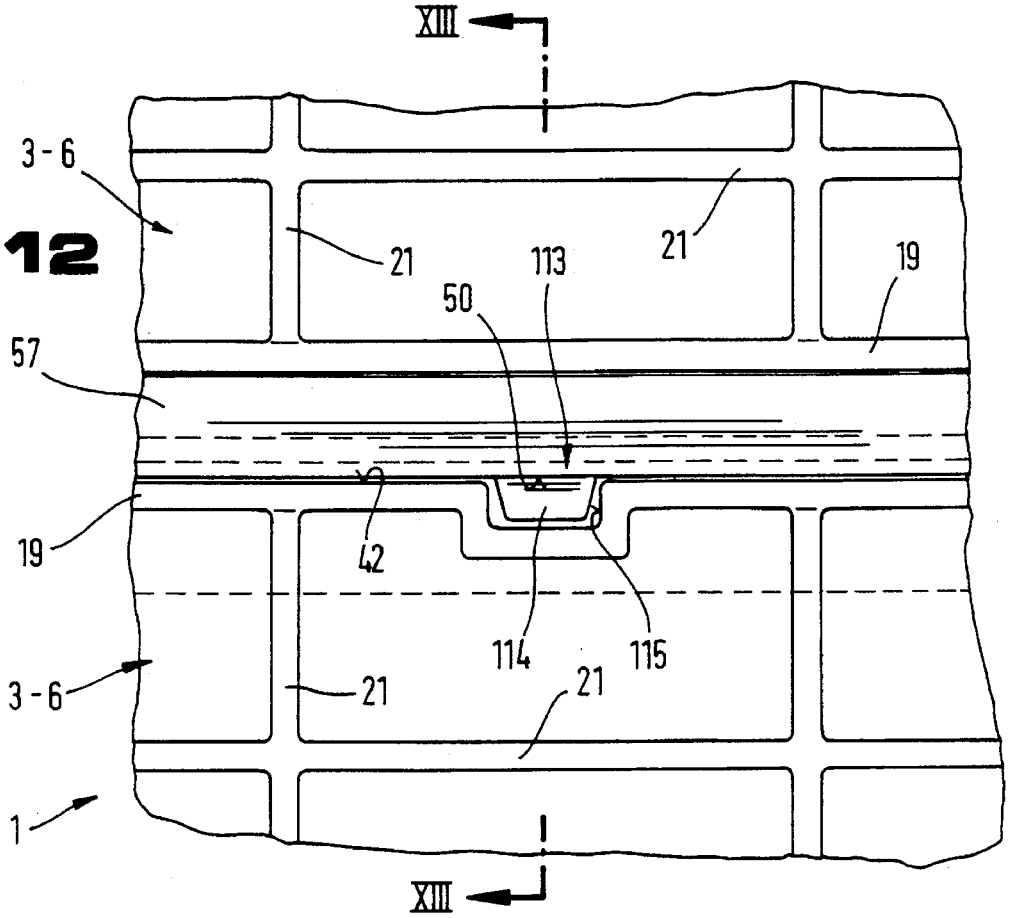
FIG. 12 shows a positioning device between the base and the side wall parts of the containers according to the invention, in partial view, with the containers stacked onto each other.
Figure 13:
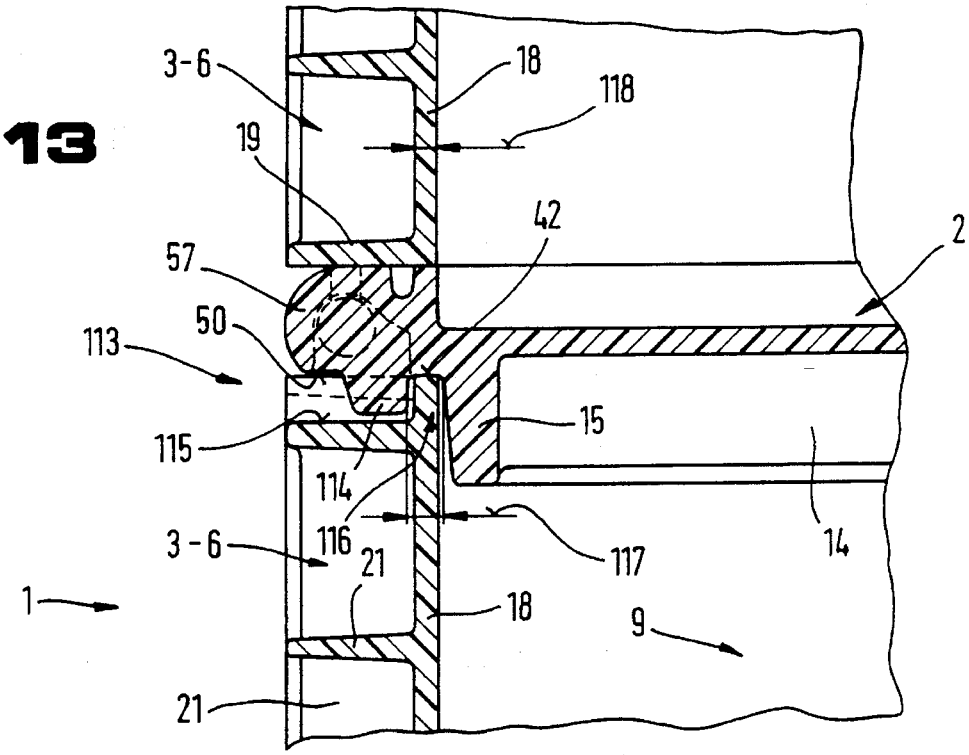
FIG. 13 shows the positioning device in section, according to lines XIII—XIII in FIG. 12.

FIG. 12 and 13 show a partial region of containers 1 stacked onto each other with a positioning device 113. This is formed by positioning elements 114, which are arranged at a distance from each other in circumferential direction of the container 1 on the marginal strips 57 adjoining the base 2, in particular are formed thereon and project over the underside 50. Associated with the positioning elements 114 are groove-shaped mounting depressions 115 in the marginal strips 19 forming the upper edge 42 and adjoining the side wall parts 3,4,5,6. These mounting depressions 115 are delimited in the direction of the interior 9 of the container 1 by the wall plates 18. An intermediate space 116 between the marginal strips 15 of the base 2 and the positioning element 114 has a width 117, which corresponds approximately to a thickness 118 of the wall plate 18.

Through this construction of the positioning device 113, the side wall parts 3,4,5,6 in the stacked state of the containers 1 in the region of the upper edge 42 are comprised between the marginal strips 15 of the base 2, projecting into the interior 9, and the positioning elements 114, on the outer side of the wall plate 18, facing away from the interior 9, projecting thereover. Hence, on the one hand, a reliable mounting of the stacked containers I on each other is ensured and, on the other hand, loads acting on the side wall parts 3,4,5,6 from the interior 9 are received by the positioning elements 114 or the base 2 of the container arranged thereabove. Thereby, buckling of the side wall parts 3,4,5,6 and also excess stresses of the connecting arrangements 35 are avoided.

Finally, it is also pointed out that in each case individual combinations of features described in the individual example embodiments, in particular those characterised in the sub-claims, may also represent constructions in accordance with the invention which are independent of the others and are separate in themselves.

Furthermore, for a better understanding of the function of the container according to the invention, parts thereof are partially illustrated diagrammatically and disproportionately.

Especially the individual embodiments shown in FIG. 1;2;3,4;5,6;7,8,9,10;11;12,13 can form the subject of independent solutions in accordance with the invention. The problems and solutions according to the invention in this respect are to be seen from the detailed descriptions of these figures.

1 container
2 base
3 side wall part
4 side wall part
5 side wall part
6 side wall part
7 longitudinal and transverse side face
8 articulation arrangement
9 interior
10 surface
11 base plate
12 standing face
13 underside
14 cross-piece
15 marginal strip
16 height
17 total thickness
18 wall plate
19 marginal strip
20 outer surface
21 cross-piece
22 opening
23 reinforcement element
24 handle opening
25 covering surface
26 length
27 width
28 height
29 depth
30 end side face
31 overlapping region
32 width -continued 33 height
34 total thickness
35 connecting device
36 mounting
37 centering and/or locking element
38 coupling device
39 centering and/or locking mounting
40 centering extension
41 coupling extension
42 upper edge
43 distance
44 distance
45 centering mounting
46 coupling opening
47 locking device
48 stop
49 support face
50 underside
51 groove
52 groove base
53 depth
54 width
55 longitudinal central axis
56 thickness
57 marginal strip
58 radius
59 distance
60 swivel pin
61 connecting cross-piece
62 side face
63 distance
64 recess
65 thickness
66 length
67 width
68 end region
69 end region
70 holding extension
71 holding chamber
72 end face
73 locking element
74 stop face
75 slit
76 weakened region
77 double arrow
78 extension
79 recess
80 contact face
81 distance
82 distance
83 slide path
84 control edge
85 distance
86 prestressing or holding-back device
87 strip element
88 recess
89 contact face
90 surface
91 slit width
92 slit width
93 thickness
94 width
95 side face
96 distance
97 thickness
98 detent arm
99 wall section
100 angle
101 angle
102 bearing face
103 distance
104 bevel
105 arrow
106 width
108 height
110 length
111 centering element
112 bore -continued

| | |
|---|---|
| 113 | positioning device |
| 114 | positioning element |
| 115 | mounting depression |
| 116 | intermediate space |
| 117 | width |
| 118 | thickness |

I claim:

1. A container comprising (a) a base having
  (1) a surface,
  (2) an underside and
  (3) longitudinally and transversely extending circumferential side faces between the surface and the underside, (b) a first pair of side walls facing each other and a second pair of side walls facing each other, each side wall having
  (1) a surface facing the surface of the base and
  (2) end faces circumferentially delimiting the surface of the side wall, (c) an articulation device pivotally connecting at least one side wall of each pair to the base whereby the pivotally connected side wall may be outwardly pivoted about a pivoting axis from a first position wherein the side wall extends perpendicularly to the base to a second position wherein the side wall is coplanar with the base,
  (1) the surfaces of the base and of the side walls defining an interior chamber of the container in the first position, and
  (2) opposite ones of the end faces of the side walls of the second pair defining overlapping regions with the surfaces of the side walls of the first pair, (d) a connecting device arranged in each overlapping region, the connecting device comprising
  (1) a coupling comprised of an extending part defining a slot-shaped recess and an opening arranged to be engaged by the extending part, and
  (2) a centering device comprised of an extending part and a receiving portion, the extending part of the centering device being arranged to be received in the receiving portion,
  (3) the extending parts of the coupling and centering device projecting from a respective one of the opposite end faces of the side walls of the second pair,
  (4) the openings and the receiving portions being arranged in a respective one of the surfaces of the side walls of the first pair in the transition regions, and
  (5) an elastically deformable detent arm arranged to project into and engage a contact face of the slot-shaped recess facing the end face of the side walls of the second pair in the first position, each detent arm having an end face facing a bearing face of the opening and enclosing an acute angle with the surface of the side wall of the first pair to extend in a direction facing away from the interior chamber, the elastically deformable detent arm exerting a spring force upon the contact face.

2. The container of claim 1, further comprising a locking device arranged to exert a prestressing force in a direction of the spring force.

3. The container of claim 1, wherein the coupling and the centering device are spaced from each other along a height of the opposite end faces corresponding to a depth of the interior chamber.

4. The container of claim 3, wherein the coupling device is arranged adjacent an upper edge of the side walls of the second pair.

5. The container of claim 1, wherein the side walls comprise a plate defining the surface of the side walls and a marginal strip defining the end faces, the detent arm being integral with the marginal strip of the side walls of the first pair and enclosing an angle of about 10° with the surface of the side walls of the second pair.

6. The container of claim 5, wherein the contact face encloses an angle of about 10° with the surface of the side walls of the second pair.

7. The container of claim 1, wherein the slot-shaped recess is conically tapered and has an outwardly facing minimal width approximately corresponding to a thickness of the detent arm.

8. The container of claim 1, wherein the extending coupling parts have a plurality of spaced-apart slot-shaped recesses along a height of the end faces.

9. The container of claim 1, wherein the end face of the detent arm and the bearing face are spaced a distance exceeding the width of the extending coupling part.

10. The container of claim 1, wherein the extending parts of the centering device project from the opposite end faces and are elongated in a longitudinal direction of the opposite end faces, said extending parts having a trapezoidal cross section, and the receiving portions are groove-shaped pockets.

11. The container of claim 1, wherein the extending parts of the centering device are frusto-conical elements projecting from the opposite end faces, and the receiving portions are bores in the side walls in the transition region.

12. The container of claim 1, wherein the base and side walls comprise a plate defining the surfaces and a marginal strip defining the end faces and extending outwardly from the plate surface, and the articulation device comprises a pivot pin connected to a respective one of the marginal strips by a connecting web, the pivot pin being pivotally held in a groove in the longitudinally and transversely extending circumferential side faces between the surface and the underside of the base.

13. The container of claim 12, wherein the circumferential side faces define an arcuate surface transversely to the elongation thereof, the pivoting axis extending along the center of the arcuate surface.

14. The container of claim 12, further comprising an elastically deformable stop element integral with the base and facing an end face of the pivot pin, the stop element being arranged to counteract an axial displacement of the pivot pin.

15. The container of claim 14, wherein the groove is closed at the underside of the base adjacent an end of the pivot pin opposite the end face thereof.

16. The container of claim 1, wherein the side walls and the base comprise a plate defining the surfaces and a marginal strip defining the end faces, further comprising a locking device comprising stops projecting from the marginal strips of the side walls in the direction of the base and cooperating with recesses in the marginal strips of the base, which recesses define support faces for the stops.

17. The container of claim 16, wherein the support faces for the stops are eccentrically arranged with respect to the pivoting axis, further comprising prestressing devices arranged to hold the side walls against pivoting from the first position into the second position.

18. The container of claim 17, wherein the prestressing devices are bead elements projecting from the surface of the base and engaging recesses in the marginal strips of the side walls.

19. The container of claim 1, wherein the base comprises a plate defining the surface and marginal strips defining the longitudinally and transversely extending circumferential side faces, further comprising positioning elements projecting from the marginal strips towards a support surface for the container and spaced from each other along the marginal strips.

20. The container of claim 19, wherein the side walls comprise a plate defining the surfaces and marginal strips defining the end faces, said marginal strips defining recesses receiving the positioning elements.

21. The container of claim 20, wherein the positioning elements and the recesses are vertically aligned with respect to the support surface.

22. The container of claim 20, wherein the positioning elements and the recesses have corresponding cross sections in planes extending parallel to the support surface.

23. The container of claim 20, wherein the plates delimit the recesses.

24. The container of claim 1, wherein the base, the side walls, the articulation device and the connecting device are shaped synthetic resin parts.

* * * * *